US008945347B2

(12) United States Patent
Petit-Conil et al.

(10) Patent No.: US 8,945,347 B2
(45) Date of Patent: Feb. 3, 2015

(54) METHOD FOR MECHANICAL PULP PRODUCTION

(75) Inventors: Michel Petit-Conil, Grenoble (FR); J. Mark A. Hoddenbagh, Ontario (CA); Jeffrey S. Tolan, Ontario (CA)

(73) Assignee: Centre Technique de l'Industrie des Papiers, Cartons et Celluloses, Saint-Martin d'Heres (FR)

( * ) Notice: Subject to any disclaimer, the term of this patent is extended or adjusted under 35 U.S.C. 154(b) by 1540 days.

(21) Appl. No.: 11/579,493

(22) PCT Filed: May 3, 2005

(86) PCT No.: PCT/CA2005/000674

§ 371 (c)(1),
(2), (4) Date: Jun. 25, 2007

(87) PCT Pub. No.: WO2005/106110

PCT Pub. Date: Nov. 10, 2005

(65) Prior Publication Data

US 2009/0107643 A1 Apr. 30, 2009

Related U.S. Application Data

(60) Provisional application No. 60/567,482, filed on May 3, 2004.

(51) Int. Cl.

| | |
|---|---|
| ***D21C 5/00*** | (2006.01) |
| ***D21B 1/02*** | (2006.01) |
| *D21C 3/00* | (2006.01) |

(52) U.S. Cl.

CPC ..... *D21B 1/021* (2013.01); *D21C 5/005* (2013.01); *D21C 3/00* (2013.01)

USPC ..... 162/24; 162/25; 162/70

(58) Field of Classification Search

USPC ..... 162/24, 25, 70

See application file for complete search history.

(56) References Cited

U.S. PATENT DOCUMENTS

| | | | | |
|---|---|---|---|---|
| 5,591,304 | A | 1/1997 | Tolan et al. | |
| 6,267,841 | B1 * | 7/2001 | Burton | 162/24 |
| 2003/0166263 | A1 * | 9/2003 | Haushalter et al. | 435/287.2 |
| 2005/0241785 | A1 * | 11/2005 | Peng et al. | 162/72 |

FOREIGN PATENT DOCUMENTS

| | | |
|---|---|---|
| EP | 0 430 915 | 6/1991 |
| EP | 0 687 320 | 12/1995 |
| EP | 0 692 043 | 1/1996 |
| WO | 91/11552 | 8/1991 |

(Continued)

OTHER PUBLICATIONS

Viikari, "Pretreatments of Wood Chips in Pulping Processes", Wood Wisdom, (1998-2001) 115-121.

(Continued)

*Primary Examiner* — Jacob Thomas Minskey
(74) *Attorney, Agent, or Firm* — Cooley LLP

(57) ABSTRACT

A method of producing hardwood pulp is provided. This method comprises treating hardwood chips with one or more than one Family 11 xylanase enzyme in the absence of adding an oxidizing enzyme for about 5 minutes to about 120 minutes, to produce a treated chip mixture. The treated chip mixture is then mechanically refined to produce the hardwood pulp.

19 Claims, 3 Drawing Sheets

(56) References Cited

FOREIGN PATENT DOCUMENTS

| | | | |
|---|---|---|---|
| WO | WO 9203541 | A1 * | 3/1992 |
| WO | 94/20666 | | 9/1994 |
| WO | 94/20667 | | 9/1994 |
| WO | 97/40194 | | 10/1997 |
| WO | WO 9740194 | A1 * | 10/1997 |
| WO | WO 03040462 | A1 * | 5/2003 |
| WO | 2004/022842 | | 3/2004 |

OTHER PUBLICATIONS

Cort et al., "Alkaline peroxide mechanical pulping of hardwoods", Tappi Journal, vol. 74, No. 6 (1991) 79-84.

* cited by examiner

METHOD FOR MECHANICAL PULP PRODUCTION

RELATED APPLICATIONS

The present application is a U.S. National Phase Application of International Application PCT/CA2005/000674, filed May 3, 2005, which claims the benefit of U.S. Provisional Application No. 60/567,482, filed May 3, 2004, all of which are herein incorporated by reference in their entirety for all purposes.

FIELD OF INVENTION

The present invention relates to methods of producing pulp. More specifically, the present invention relates to methods of producing mechanical pulp using enzymes.

BACKGROUND OF THE INVENTION

The production of mechanical pulp is a major industry with over 40 million tonnes of pulp produced annually worldwide. Mechanical pulps are used in a wide variety of papers. Unbleached or slightly bleached pulps are used in the production of newsprint and constitute the largest single usage of mechanical pulps. Mechanical pulps that have been moderately bleached are used to manufacture uncoated products such as supercalendered paper, coated products such as lightweight-coated paper, paperboard and tissue products. Highly bleached mechanical pulps are used in coated and uncoated fine papers such as photocopy paper, technical grades such as carbonless and tissue products. Mechanical pulps are characterized by having high yields in excess of 80% from wood, favorable mechanical properties such as bulk and optical properties such as opacity and lower manufacturing costs than kraft pulps.

The main characteristic of mechanical pulps is that the fibers in the wood chips are separated by mechanical action rather than through chemical action as in kraft pulping. There are several mechanical pulping processes known in the art as taught by Smook, (1992) Handbook for Pulp & Paper Technologists (which is herein incorporated by reference). A minority of mechanical pulp is produced using a stone groundwood method, which consists of grinding debarked logs with a pulp stone to separate the fibers.

The majority of mechanical pulps are made using a refiner method, where wood chips or pulp are passed between plates having raised (bars and dams) and depressed (grooves) segments. The plates are installed in a refiner and at least one of the plates is rotated. The chips or pulp move from the center of the plates to the edges and the chips are converted from chips into coarse pulp or the coarse pulp is further refined by the action of the plates. This process of converting chips to coarse pulp is known as primary refining or defibering and is performed in a primary refiner as is familiar to those skilled in the art. The process of refining the coarse pulp to refined pulp is known as secondary refining and is performed in a secondary refiner as is familiar to those skilled in the art. Other refining stages to further refine the pulp may follow the secondary refining process. The process of defibering, followed by secondary refining and other refining stages, is known as refining.

In the process of the refiner method, the furnish, consisting of softwood or hardwood chips or mixtures thereof, is washed to remove dirt and debris. The chips may then be steamed to remove air and heat the chips prior to refining. The chips may also be pre-treated by compression in a device such as a screw press, followed by introduction to a chemical solution in which the chips relax, absorbing the solution, which process is known as impregnation to those of skill in the art. The chips are then introduced to either an atmospheric or pressurized primary refiner and converted into coarse pulp. The coarse pulp is typically refined in a secondary refiner, after which it may be screened, cleaned or both. Rejects from the screening-cleaning process are re-refined and then added to the main stock. The pulp accepts may be bleached, either reductively and/or oxidatively. The finished pulp may be dried and baled or sent to storage prior to introduction to a paper machine.

One problem that has been facing the industry is the high, and increasing, cost of electricity. The refining of one tonne of mechanical pulp typically requires 800 to 3500 kWh of electricity. For example, at a cost of $0.10/kWh, the cost of electricity is $80 to $350/tonne pulp. This high cost reduces the competitiveness of the pulp in some applications and decreases the profitability of the operation. In addition, the limited amounts of electricity available in some regions can make it difficult for a mill to operate while drawing this much electrical power.

A second problem related to the high electricity usage is the damage to pulp fibers caused by the high energy input. This damage can negatively affect the properties of the final products.

The use of biological products such as fungi, bacteria and enzymes to decrease the amount of chemicals required for processing kraft pulp is known. For example, U.S. Pat. No. 5,591,304 (Tolan et al.) discloses using a hemicellulase on kraft brownstock pulp in the pH range of 7.0 to 9.0 in order to decrease bleach chemical usage.

The use of biological products has been investigated in mechanical pulping. This includes treatments of wood chips or of refined pulp. For example, WO 97/40194 (Eachus and Kaphammer) teaches pre-treating Loblolly pine wood chips with *Ceriporiopsis* fungi, CLARIANT CARTAZYME® HS enzyme (contains xylanase) or mixtures of CLARIANT CARTAZYME® NS enzyme (contains xylanase) and SIGMA® lipase enzyme for long periods of time, which are not practical in a mill. For example, the fungal treatments are for 8 to 14 days and the enzyme treatments (e.g. CLARIANT CARTAZYME® HS or CLARIANT CARTAZYME® NS enzyme and SIGMA® lipase) are for 48 hours. Furthermore, these long fungal treatment times are not suitable in cold or warm climates due to the extremes of temperature in these climates. The enzyme treatment (CLARIANT CARTAZYME® HS) had no effect on refiner energy when the enzyme was added by submerging the wood chips in a buffered solution, but slightly decreased the refiner energy by 100 kWh/t when the enzyme was added using an IMPRESSAFINER® (a chip impregnation device). Some of the benefits desired by the industry were obtained in this method (e.g. improved pulp properties); however, there were no significant reductions in refiner energy use and the lengths of the treatment periods are impractical.

WO 2004/022842 A1 (Peng et al) teaches treating wood chips with a pectinase prior to primary refining of the chips. Energy savings of up to 500 kWh/t are obtained compared to an untreated control. This treatment can be performed in the presence of a chelant (diethylenetriaminepentaacetic acid) or sulfite, but no additional energy reductions above that provided by pectinase treatment in the absence of the chelant are observed. Due to the expense of pectinase, such a treatment would not be practical in a mill setting.

Viikari et al. (Pretreatments of Wood Chips in Pulp Processing, in Paavilainen, L. ed., Final report—Finnish Forest Cluster Research Programme, WOOD WISDOM, 1998-

2001, Report 3, pp. 115-121; incorporated herein by reference) discuss pretreating Norway spruce softwood chips with fungi or enzymes prior to refining. The fungal treated chips required 15% less refining energy to produce a pulp of a given freeness and having an improved tensile strength but lower brightness. The energy consumption for refining was decreased by using enzymes that modify lignin and by 10-20% when using enzymes that modify cellulose or hemicellulose. No details of the methods, conditions of pretreatment or the enzymes used are provided.

The treatment of pulp after primary refining to decrease energy requirements has also been investigated. U.S. Pat. No. 6,267,841 (Burton) teaches treatment of primary refiner hardwood or softwood pulp with enzyme to decrease the energy requirements of the secondary refining operation. EP 0 687 320 B1 and EP 0 692 043 B1 (Viikari et al.) disclose treating once refined pulp with cellulase or a cellulase/mannanase mixture prior to secondary refining in order to decrease the refining energy. One disadvantage of treating pulp after primary refining is that most of the refining energy is consumed in primary refining, so treating pulp after primary refining can only have limited impact. Another disadvantage is that most mills transfer the pulp directly from the primary to the secondary refiner and there is no equipment or storage tank provided to treat the pulp between the two refining stages. An additional storage tank would be required to implement this technology.

EP 0 430 915 A1 (Vaheri '915) teaches the use of hydrolytic enzymes, from either *Aspergillus* or *Trichoderma* fungi to decrease refining energy. The enzymes may be mixed with either wood, wood chips or pulp refined at least once prior to subsequent refining. An example involving xylanase treatment of defibered spruce (once refined) pulp, at 20° C., for a 3 hour period is provided. An energy savings of about 300 kWh/tonne was obtained. However, the specified conditions are not practical for use in a mill setting.

WO 91/11552 (Vaheri '552) discloses a method of treating fibrous material, including wood chips and pulp, simultaneously with hydrolytic and oxidizing enzymes and adjusting the redox potential to 200 mV prior to primary or secondary refining and a corresponding reduction in the refining energy. However, the oxidizing enzymes described by Vaheri '552 (WO 91/11552) are not commercially available and adjusting the redox potential is costly.

Therefore, in spite of previous efforts, there is no commercially viable means of using biological products or methods for reducing refining energy. There remains a need in the art for novel products that will decrease refining energies, lead to improved fiber properties and be commercially viable.

SUMMARY OF THE INVENTION

The present invention relates to methods of producing pulp. More specifically, the present invention relates to methods of producing mechanical pulp using enzymes.

It is an object of the invention to provide an improved method of mechanical pulping.

According to the present invention there is provided a method (A) of producing hardwood pulp comprising:

a. treating hardwood chips with a Family 11 xylanase enzyme in the absence of adding an oxidizing enzyme for about 5 minutes to about 120 minutes, to produce a treated chip mixture; and
b. mechanically refining the treated chip mixture to produce the hardwood pulp.

The hardwood chips may be selected from the group consisting of aspen, poplar, birch, maple, oak, eucalyptus and acacia hardwood species and a combination thereof.

The present invention also provides the method (A) as defined above wherein, in the step of treating (step a.), the Family 11 xylanase is selected from the group consisting of *Trichoderma, Actinomadura, Aspergillus, Aureobasidium, Bacillus, Cellulomonas, Chaetomium, Chainia, Clostridium, Fibrobacter, Humicola, Neocallimasterix, Nocardiopsis, Ruminococcus, Schizophyllum, Streptomyces, Thermomonospora* and *Thermomyces*. Furthermore, if the enzyme is a *Trichoderma* enzyme xylanase, then it is preferred that the enzyme is *Trichoderma reesei* Xylanase II.

The present invention pertains to the method as described above (A) wherein the step of treating (step a.) is performed at a temperature from about 35° C. to about 95° C., at a pH of from about pH 3 to about 11 and wherein the Family 11 xylanase is present at an amount from about 0.01 to about 600 xylanase units per gram of hardwood chips or at an amount from about 0.1 to about 600 grams of xylanase protein per tonne of hardwood chips.

The present invention also relates to the method (A) as described above wherein, in the step of treating (step a.), the Family 11 xylanase is added to the hardwood chips using a soaking bin or a wood compression-relaxation device. If a wood compression-relaxation device is used, then it is preferred that the device comprise a screw press and an impregnator. Furthermore, the wood compression-relaxation device may also be used to add chemical agents selected from the group consisting of an acid, a base, an oxidant, a reductant, a chelant, a stabilizer, a surfactant, an enzyme and a combination thereof, to the hardwood chips.

The present invention also pertains to the method (A) as described above wherein, prior to the step of treating (step a.), the hardwood chips may be treated with one or more than one chemical agent selected from the group consisting of an acid, a base, an oxidant, a reductant, a chelant, a stabilizer, a surfactant, an enzyme and a combination thereof, in a soaking or wood compression-relaxation device. Alternatively, the present invention also pertains to the method (A) as described above wherein, after the step of treating (step a.) and before the step of refining (step b.), the hardwood chips may be treated with one or more than one chemical agent selected from the group consisting of an acid, a base, an oxidant, a reductant, a chelant, a stabilize, a surfactant, an enzyme and a combination thereof, in a soaking or wood compression-relaxation device. The wood compression-relaxation device may comprise a screw press and an impregnator.

The present invention also provides the method (A) as described above wherein, prior to the step of treating (step a.), the hardwood chips are thermally treated. Alternatively, the hardwood chips may be thermally treated after the step of treating (step a.) and before the step of refining (step b.). In either case, the thermal treatment may comprise treating the hardwood chips with steam or hot water.

The present invention also pertains to the method (A) as described above wherein, in the step of treating (step a.), the Family 11 xylanase enzyme is added with a cellulase, a hemicellulase, a cell wall enzyme, an esterase or a combination thereof. The hemicellulase may be selected from the group consisting of mannanase, arabinase, galactase, pectinase and a combination thereof; the cell wall enzyme may be selected from the group consisting of expansin, swollenin, xyloglucan endotransglycosylase (XET) and a combination thereof; and the esterases may comprise ferulic esterases.

The present invention also pertains to the method (A) as described above wherein the step of treating (step a) is performed in the absence of adding a lipase enzyme.

The present invention provides a method (B) of producing hardwood pulp comprising:

a. treating hardwood chips with one or more than one Family 11 xylanase enzyme for about 5 minutes to about 120 minutes to produce a treated chip mixture; and
b. mechanically refining the treated chip mixture to produce the hardwood pulp, wherein either before or after the step of treating (step a.) one or more than one oxidizing enzyme is added to the hardwood chips. Furthermore, the oxidizing enzyme may be selected from the group consisting of laccase, ligninase, manganese peroxidase and combinations thereof.

The invention relates to methods of refining hardwood chips into pulp. More specifically the invention relates to methods of treating wood chips with enzymes prior to refining the chips and then refining the chips to convert the chips into pulp.

The method of the invention replaces a conventional refining process that takes place without the use of enzymes and requires higher refining energies to convert the wood chips to pulp. As described herein, in the presence of one or more than one Family 11 xylanase, and optionally other enzymes, hardwood chips can be converted to pulp using less refining energy than the conventional process. The energy reductions obtained using the method of the present invention are about 10-50% compared to a control process where the wood chips have not been treated with a Family 11 enzyme or a Family 11 enzyme in combination with other enzymes. However, it is also noted that xylanase treatment of softwood chips prior to refining using the method described herein does not reduce refiner energies compared to the processing of an untreated softwood control. Therefore, the method of the present invention is directed to the processing of hardwood chips.

The method of the present invention may be performed at any mill as part of a larger chip treatment, refining and pulp bleaching process. Furthermore, the process may comprise Refiner Mechanical Pulping (RMP), Thermo-Mechanical Pulping (TMP), Chemi-Thermo-Mechanical Pulping (CTMP), Bleached Thermo-Mechanical Pulping (BTMP), Bleached Chemi-Thermo-Mechanical Pulping (BCTMP), Alkaline Peroxide Mechanical Pulping (APMP) or the production of Medium Density Fiberboard (MDF).

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Figure 1:
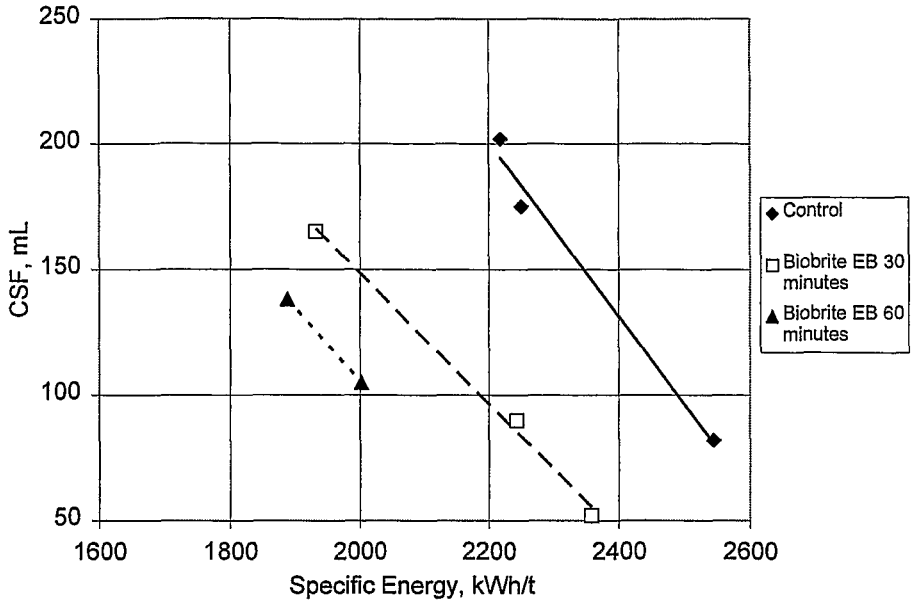
FIG. 1 shows a relationship between the freeness of the pulp (CSF; Canadian Standard Freeness) and the energy consumption (specific energy) for pulp produced from poplar chips in the absence of enzyme (Control) or chips that have been treated with BIOBRITE® EB enzyme at a dosage of 20 XU/g chips for 30 minutes or 60 minutes as described in Example 6.

The following description is of a preferred embodiment.

The present invention relates to methods of producing pulp. Furthermore, the present invention relates to methods of producing mechanical pulp using enzymes and methods of refining hardwood chips into pulp are provided. More specifically the invention relates to methods of treating hardwood chips with enzymes prior to refining the chips and converting them into pulp.

The following description is of an embodiment by way of example only and without limitation to the combination of features necessary for carrying the invention into effect.

According to the present invention, there is provided a process of treating hardwood chips prior to refining, with refiner energy reductions of 10-50% being attained for chips processed using the present method over chips processed using a control treatment. The method of the present invention comprises treating the hardwood chips with an enzyme prior to the chips being converted into pulp in a refining process. Preferably, the enzyme treatment of chips involves the use of one or more than one xylanase enzyme, for example a Family 11 xylanase enzyme. The enzyme treatment mixture may also optionally comprise other enzymes. Other enzymes, for example cellulases, hemicellulases, cell wall enzymes, esterases, or combinations of these enzymes, may be added to the reaction mixture before, along with, or after, the treatment of the hardwood chips with the Family 11 xylanase. This includes the addition of purified or semi-purified enzyme preparations or crude extracts. Oxidizing enzymes may be added prior to or after the treatment of hardwood chips with the Family 11 xylanase, preferably in the absence of xylanase.

Prior to treating the hardwood chips with a Family 11 xylanase, the chips may be treated with one or more than one chemical agent, for example an acid, a base, an oxidant, a reductant, a chelant, a stabilizer, a surfactant, an enzyme and a combination thereof. Additionally, after treating the hardwood chips with a Family 11 xylanase and before mechanically refining the hardwood chips, the chips may be treated with one or more than one chemical agent, for example an acid, a base, an oxidant, a reductant, a chelant, a stabilizer, a surfactant, an enzyme and a combination thereof.

Therefore, the present invention provides a method of producing hardwood pulp comprising:

a. treating hardwood chips with one or more than one Family 11 xylanase enzyme in the absence of adding an oxidizing enzyme for about 5 minutes to about 120 minutes, to produce a treated chip mixture; and b. mechanically refining the treated chip mixture to produce the hardwood pulp.

By hardwood, it is meant a wood species that is characterized by fibers shorter than 2.5 millimeters, the presence of vessel elements and lignin concentrations not exceeding 25% by weight, for example as taught by Smook (1992). Hardwoods can be classified by the scheme published by United States Department of Agriculture (2004). Examples of hardwoods, that are not meant to be limiting, are provided in Table 1.

TABLE 1

Hardwoods

| Sub-class | Order | Family | Genus | Species | Common Names |
|---|---|---|---|---|---|
| Dilleniidae | Salicales | Salicaceae | *Populus* L. | *P. tremuloides* | Aspen |
| | | | | *P. tremula* | Poplar |
| Rosidae | Fabales | Fabaceae | *Acacia* P. Mill. | *A. rigidula* | Acacia |
| | Myrtales | Myrtaceae | *Eucalyptus* L'Hér. | *E. grandis* | Eucalyptus |
| | Rosales | Rosaceae | *Malus* P. Mill. | *M. sylvestris* | Apple |
| | Sapindales | Aceraceae | *Acer* L. | *A. saccharinum* | Maple |
| | | | | *A. platanoides* | |
| Hamamelidai | Fagales | Betulaceae | *Betula* L. | *B. papyrifera* | Birch |
| | | | | *P. pendula* | |
| | | | *Alnus* L. | *A. incana* | Alder |
| | | Fagaceae | *Fagus* L. | *F. grandifoli* | Beech |
| | | | | *F. sylvatica* | |
| | | | *Quercus* L. | *Q. falcate* | Oak |
| | | | | *Q. velutina* | |
| | | | *Castanea* P. Mill. | *C. dentate* | Chestnut |

Hardwood chips (chips) may be produced from whole pulp logs that have been debarked and chipped for pulp production or from residual wood that is a byproduct of a sawmill or other wood conversion process as is known in the art, for example, but not limited to U.S. Pat. No. 5,103,883 (Viikari et al., which is incorporated herein by reference).

Hardwood chips may optionally be treated thermally, chemically or mechanically prior to the enzyme treatment. Suitable thermal treatment could include steaming the chips, for example but not limited to the process described in U.S. Pat. No. 2,008,898 (Asplund; which is incorporated herein by reference). Suitable chemical treatment could include impregnation with one or more than one enzyme, acid, base, oxidant, reductant, chelant, stabilizer, surfactant and a combination thereof, using, for example, but not limited to the processes described in WO 97/40194 (Eachus), WO 95/09267 (Aho), U.S. Pat. No. 4,145,246 (Goheen et al.), U.S. Pat. No. 5,055,159 (Blanchette et al.) or Messner et al. (Fungal Treatment of Wood Chips for Chemical Pulping, in Environmentally Friendly Technologies for the Pulp and Paper Industry, Young, R. A. and Akhtar, M., eds., John Wiley & Sons 1998, pp. 385-419), all of which are incorporated herein by reference. Suitable mechanical treatment could include pressing the hardwood chips in a screw press or a roll press. The methods to pre-treat hardwood chips as just described would be known to one of skill in the art.

The hardwood chips may optionally be treated thermally, chemically or mechanically after an enzyme pre-treatment but prior to a defibering step (also referred to as refining). Suitable thermal treatment could include steaming the chips or heating the chips with hot water. Suitable chemical treatment could include impregnation with one or more than one enzyme, acid, base, oxidant, reductant, chelant, stabilizer, surfactant and a combination thereof. Suitable mechanical treatment could include pressing the hardwood chips in a screw press or a roll press.

By the term "enzyme treatment" or "enzyme pre-treatment", it is meant contacting the chips with an enzyme solution. The enzyme treatment may include:

spraying the chips with a solution containing the enzyme, soaking the chips in a solution containing the enzyme, compressing the chips in a mechanical compression device, such as, but not limited to a screw press, expelling the compressed chips into a solution containing the enzyme and, after the chips have absorbed the enzyme solution, removing the chips from the enzyme solution and placing the chips in a storage vessel for a period of time, or compressing the chips in a mechanical compression device, such as, but not limited to a screw press and expelling the compressed chips into a solution containing the enzyme and soaking the chips in the enzyme solution for a period of time.

Furthermore, these treatments may be combined. A preferred method of treatment is to compress and expel the chips into a solution containing the enzyme and soak the chips in the enzyme solution. As the chips relax they decompress and absorb the solution and the enzyme contained in the solution. The compression-relaxation cycle is known to those skilled in the art as impregnation. After the chips have absorbed the solution and enzyme contained in the solution, they can be removed from the solution and placed in a storage vessel for a period of time to allow the enzyme to react with the chips. A non-limiting example of a method of compressing wood chips is disclosed in WO 97/40194 (Eachus et al.; which is incorporated herein by reference).

Hardwood chips that are impregnated may be reacted with enzymes in the enzyme solution for about 5 to about 120 minutes, or any time interval therebetween, at a temperature from about 35° C. to about 95° C., or any temperature therebetween and a pH of from about 3 to about 11 or any pH therebetween. For example, the impregnated chips may be treated for about 5, 10, 15, 20, 25, 30, 35, 40, 45, 50, 55, 60, 65, 70, 75, 80, 85, 90, 95, 100, 105, 110, 115 or 120 minutes or any amount therebetween, at a temperature of about 35° C., 40° C., 45° C., 50° C., 55° C., 60° C., 65° C., 70° C., 75° C., 80° C., 85° C., 90° or 95° C. or any amount therebetween, and at a pH of about 3, 3.5, 4, 4.5, 5, 5.5, 6, 6.5, 7, 7.5, 8, 8.5, 9, 9.5, 10, 10.5 or 11, or any amount therebetween. However, it is to be understood that other treatment conditions may be employed that fall within the overall parameters as just defined, as one of skill in the art may readily adjust the reaction conditions as desired. Furthermore, as stated above, additional enzymes, for example cellulases, hemicellulases, cell wall enzymes, esterases, or combinations of these enzymes, may be added to the treatment mixture before, during or following the treatment involving a Family 11 xylanase.

Preferably, the xylanase enzyme used in the enzyme treatment is a Family 11 xylanase. Family 11 xylanase (EC 3.2.1.8) includes wild type or modified Family 11 xylanase, for example but not limited to those disclosed in WO 03/046169 (Sung et al. which is incorporated herein by reference). By Family 11 xylanase, it is meant a xylanase comprising amino acids common to other Family 11 xylanases, including two glutamic acid (E) residues which may serve as catalytic residues. The glutamic acid residues are found at positions 86 and 177 (see FIG. 1 of WO 03/046169; Sung; which is incorporated herein by reference) based on Tr2 amino acid numbering (*Trichoderma reesei* xylanase II enzyme). As can be seen in FIG. 1 of WO 03/046169, Family 11 xylanases share extensive amino acid sequence similarity. Examples of Family 11 xylanases include, but are not limited to wild type or modified enzymes obtained from *Trichoderma, Actinomadura, Aspergillus, Aureobasidium, Bacillus, Cellulomonas, Chaetomium, Chainia, Clostridium, Fibrobacter, Humicola, Neocallimasterix, Nocardiopsis, Ruminococcus, Schizophyllum, Streptomyces, Thermomonospora* and *Thermomyces*. Additional examples of Family 11 xylanases that may be used in accordance with the present invention include, but are not limited to:

| | |
|---|---|
| *Aspergillus niger* | Xyn A |
| *Aspergillus awamori* var. *kawachii* | Xyn B |
| *Aspergillus kawachii* | Xyn C |
| *Aspergillus tubigensis* | Xyn A |
| *Bacillus circulans* | Xyn A |
| *Bacillus pumilus* | Xyn A |
| *Bacillus subtilis* | Xyn A |
| *Cellulomonas fimi* | Xyn D |
| *Chainia* spp. | Xyn |
| *Clostridium acetobutylicum* | Xyn B |
| *Clostridium stercorarium* | Xyn A |
| *Fibrobacter succinognees* | Xyn II |
| *Neocallimasterix patriciarum* | Xyn A |
| *Nocardiopsis dassonvillei* | Xyn II |
| *Ruminococcus flavefaciens* | Xyn A |
| *Schizophyllum cimmune* | Xyn |
| *Streptomyces lividans* | Xyn B |
| *Streptomyces lividans* | Xyn C |
| *Streptomyces* sp. No. 36a | Xyn |
| *Streptomyces thermoviolaceus* | Xyn II |
| *Thermomonospora fusca* | Xyn A |
| *Thermomyces lanuginosus* | Xyn |
| *Trichoderma harzianum* | Xyn |
| *Trichoderma reesei* | Xyn I |
| *Trichoderma reesei* | Xyn II |
| *Trichoderma viride* | Xyn |

Structural studies of several Family 11 xylanases indicate that Family 11 xylanases from bacterial and fungal origins share the same general molecular structure (U.S. Pat. No. 5,405,769; Campbell et al.; Arase et al., 1993, FEBS Lett.; both of which are herein incorporated by reference). In addition, most Family 11 xylanases identified so far exhibit three types of secondary structure, including beta-sheets, turns and a single alpha helix.

As described herein, the hardwood chips may be treated with one or more than one Family 11 enzyme or an enzyme mixture comprising various combinations of one or more than one Family 11 xylanase, mannanase, arabinase, galactase, pectinase and cell wall enzymes. Preferably, this excludes the addition of a lipase enzyme in combination with a Family 11 xylanase. However, it should be appreciated that small amounts of lipase enzyme may be added to the chips, or low levels of lipase activity may be present, without substantially affecting the outcome of the xylanase treatment.

Any Family 11 xylanase active at conditions employed in the invention may be used in the method. Furthermore, the Family 11 xylanase may be a modified xylanase selected from the group consisting of TrX-DS1; TrX-162H-DS1; TrX-162H-DS2; TrX-162H-DS4; TrX-162H-DS8; TrX-75A; TrX-HML-105H; TrX-HML-75A-105H; TrX-HML-75C-105R; TrX-HML-75G-105R; TrX-HML-75G-105R-125A-129E; TrX-HML-75G-105H-125A-129E; TrX-HML-75A-105H-125A-129E; TrX-HML-75A-105R-125A-129E; TrX-157D-161R-162H-165H; TrX-HML-AHAE; TrX-HML-AHAE-R; TrX-HML-AHAE-RR; TrX-HML-AHAE-RRR; TrX-HML AHA-RR-DRHH; TrX-HML-AHAE-RR-DRHH; TrX-HML-AHAE-RRR-DRHH; TrX-116G; TrX-118C; TrX-HML-AHCAE-R; TrX-H-11D-ML-AHGAE-RR; TrX-HML-AHGAE-R; TrX-H-11D-ML-AHGCAE-RR; TrX-H-11D-ML-AHCAE-RR; TrX-HML; HTX13; HTX18; ITX1; ITX2; ITX2'; ITX3; ITX3'; ITX4; ITX4'; ITX5; ITX5'; Xln1-131N; HTX44; HTX44-131N (see WO03/046169; U.S. Ser. No. 60/556,061; PCT/CA2005/000448, all of which are incorporated herein by reference). The Family 11 xylanase may also be BIOBRITE® UHB xylanase, BIOBRITE® EB xylanase, BIOBRITE® HTX xylanase or wild-type *Trichoderma reesei* xylanase II.

The xylanase dosage used during enzyme treatment of chips (including spraying, soaking, compressing and expelling, compressing and expelling followed by reacting the clips with the enzyme in the enzyme solution or a combination thereof) may be between about 0.01 and about 600 xylanase units per gram of chips (XU/g) or any amount therebetween. For example, which is not to be considered limiting, the xylanase dose during chip treatment may be between about 0.1 and about 150 XU/g hardwood chips, or any amount therebetween, or it may be from about 5 to about 200 XU/g hardwood chip or any amount therebetween. For example, the xylanase dosage may be 0.01, 0.1, 5, 25, 50, 75, 100, 125, 150, 175, 200, 225, 250, 275, 300, 325, 350, 375, 400, 425, 450, 475, 500, 525, 550, 575 or 600 XU/g hardwood chips, or any amount therebetween. One of skill in the art would be able to readily modify the amount of enzyme to chip ratio as required and the specific amounts just provided should not be considered limiting. The method for determining xylanase activity is presented in Example 2.

The xylanase dosage used during enzyme treatment of chips may also be represented in terms of grams of xylanase protein per tonne of hardwood chips. For example, which is not to be considered limiting, the xylanase dosage may be between about 0.1 and 600 grams of xylanase protein per tonne of chips, or any amount therebetween, or it may be between about 2.0 and 15 grams of xylanase protein per tonne of chips, or any amount therebetween, or between about 2.5 and 12 grams of xylanase protein per tonne of chips, or any amount therebetween, or between about 3.5 and 9 grams of xylanase protein per tonne of chips or any amount therebetween. For example, the xylanase dose may be 0.1, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 10, 12, 15, 20, 30, 40, 50, 60, 70, 80, 90, 100, 125, 150, 175, 200, 225, 250, 275, 300, 325, 350, 375, 400, 425, 450, 475, 500, 525, 550, 575 or 600 grams total protein per tonne of chips or any amount therebetween. For example, in Example 4, hardwood chips are incubated over a range of Family 11 xylanase concentrations (10 to 100 gram xylanase protein/t chip) and other amounts of enzyme may also be selected.

Consistency is defined as the mass percentage of wood fiber in a slurry of wood fiber and water. The wood fiber may comprise either chips or pulp in a consistency measurement. The consistency is measured by taking a known mass of the slurry and drying it in an oven at 105° C. until the sample reaches a constant mass, at which time all of the water has been removed from the pulp. The oven dry mass of wood fiber that remains is then determined. The consistency is calculated as the quotient of oven dry mass of wood fiber divided by the mass of the slurry and expressed as a percentage.

The chip consistency to be used during the treatment stage may range from about 0.1% (w/w) to about 50% (w/w) of the total treatment mixture, or any amount therebetween. A non-limiting example of the chip consistency during the treatment stage is from about 5% (w/w) to about 40% (w/w), or any amount therebetween. Another non-limiting example of the chip consistency used during the treatment is from about 15% (w/w) to about 35% (w/w), or any amount therebetween. However, it is to be understood that the chip consistency present in the treatment mixture may be varied as required.

Other enzymes that may be applied to the chips during enzyme treatment include cellulases, hemicellulases, cell wall enzymes and esterases. Oxido-reductases may be added if they are added prior to or following treatment with the Family 11 xylanase treatment. Hemicellulases may include mannanase, arabinase, galactase, pectinase or a combination thereof. Cell wall enzymes include expansin, swollenin, xyloglucan endotransglycosylase (XET) or a combination thereof and esterases may comprise ferulic esterases.

Acids used in impregnation may include hydrochloric acid, sulfuric acid, sodium bicarbonate, formic acid, acetic acid, oxalic acid and hydroxyacetic acid, used at an addition rate of 0.01% (w/w) to 10% (w/w) on oven dried chips Hydroxyacetic acid is also known to those skilled in the art as glycolic acid. In a preferred embodiment sulfuric acid may be used during impregnation.

Bases used in impregnation may include sodium hydroxide, magnesium hydroxide, potassium hydroxide, sodium carbonate, sodium bicarbonate and sodium silicate, used at an addition rate of 0.01% (w/w) to 10% (w/w) on oven dried chips. In a preferred embodiment, sodium hydroxide and sodium silicate may be used during impregnation.

Oxidants, reductants, chelants, stabilizers and surfactants may also be used during impregnation. Non-limiting examples of oxidants include hydrogen peroxide, chlorine dioxide, oxygen, performic acid, peracetic acid and ozone, used at an addition rate of 0.01% (w/w) to 10% (w/w) on oven dried chips. If an oxidant is used, the preferred oxidant is hydrogen peroxide. Non-limiting examples of reductants include sodium sulfite, formamidine sulfinic acid, sodium hydrosulfite (also known sodium dithionte) and sodium borohydride, used at an addition rate of 0.01% (w/w) to 10% (w/w) on oven dried chips. The preferred reductants are sodium sulfite and sodium hydrosulfite. Non-limiting examples of chelants include ethylenediaminetetraacetic acid and its sodium and potassium salts (EDTA), diethylenetriaminepentaacetic acid and its sodium and potassium salts (DTPA), nitrilotriacetic acid and its sodium and potassium salts (NTA), hydroxyacetic acid and its sodium and potassium salts and oxalic acid and its sodium and potassium salts, used at an addition rate of 0.01% (w/w) to 10% (w/w) on oven dried chips. Preferred chelants include EDTA and DTPA. Non-limiting examples of stabilizers include sodium silicate, magnesium sulfate, magnesium chloride, magnesium nitrate and magnesium hydroxide, used at an addition rate of 0.01% (w/w) to 10% (w/w) on ovendried chips. Preferred stabilizers are sodium silicate, magnesium sulfate and combinations thereof. Non-limiting examples of surfactants include non-ionic surfactants such as nonylphenol ethoxylate, anionic surfactants such as sodium lauryl sulphate, cationic surfactants such as quaternary amines, and amphoteric surfactants such as betaine.

At the end of the enzyme treatment, the wood chips are fed to a mechanical refining device, which is familiar to those skilled in the art. The wood chips may be de-fibered in a primary refiner and converted into coarse pulp and the coarse pulp refined in secondary refining operation in a secondary refiner.

Defibering or primary refining typically involves introducing the chips to a mechanical refining device, as is known to those of skill in the art. In the mechanical refining device, wood chips are passed between plates having raised (bars and dams) and depressed (grooves) segments and where at least one of the plates is rotated. The chips move from the center of the plates to the edges and are converted from chips into pulp by the action of the plates.

By secondary refining, it is meant that the coarse pulp is introduced to a mechanical refining device, as known to those skilled in the art, where the coarse pulp is passed between plates having raised (bars and dams) and depressed (grooves) segments. The plates are installed in a refiner and at least one of the plates is rotated. The coarse pulp moves from the center of the plates to the edges and is refined by the action of the plates.

By a mechanical refining process, it is meant the conversion of chips to refined pulp by defibering of the chips into coarse pulp in a primary refiner and refining the coarse pulp in a secondary refiner. The secondary refining process may be followed by additional refining processes, as is familiar to those skilled in the art.

The method as described herein may be performed at mill as part of any regular chip treatment, refining and pulp bleaching process. For example the process may include Refiner Mechanical Pulping (RMP), Thermo-mechanical Pulping (TMP), Chemi-thermo-mechanical Pulping (CTMP), Bleached Thermo-mechanical Pulping (BTMP), Bleached Chemi-thermo-mechanical Pulping (BCTMP) or the production of Medium Density Fiberboard (MDF).

The present invention may be illustrated in the following examples. However, it is to be understood that these examples are for illustrative purposes only and should not be used to limit the scope of the present invention in any manner.

EXAMPLES

Example 1

Determination of Protein Concentration of Xylanase Solutions

The protein concentrations of the xylanase mixtures were determined by the Bio-Rad/Coomasie method wherein the protein in solution was treated with Coomassie Brilliant Blue dye to form a colored complex. The absorption of light at 595 nm was measured and the amount of enzyme determined in comparison to a standard cellulase enzyme treated as the protein solution. The protein in the xylanase mixtures was comprised of at least 70% xylanase protein.

Example 2

Standard Assay for the Measurement of Xylanase Activity

The endo xylanase assay is specific for endo-1,4-beta-D-xylanase activity. On incubation of azo-xylan (oat) with xylanase, the substrate is depolymerized to produce low-molecular weight dyed fragments which remain in solution on addition of ethanol to the reaction mixture. High molecular weight material is removed by centrifugation and the colour of the supernatant is measured. Xylanase activity in the assay solution is determined by reference to a standard curve. The method is based on that published by Megazyme International Ireland Limited (2003) and the product name is S-AXYO oat Azo-Xylan. The substrate is purified (to remove starch and beta-glucan). The polysaccharide is dyed with Remazolbrilliant Blue R to an extent of about one dye molecule per 30 sugar residues.

The powdered substrate is dissolved in water and sodium acetate buffer and the pH adjusted to 4.5 to provide a final solution having a concentration of 2% w/v. For the assays, unless otherwise indicated, xylanase is diluted in 0.5 M acetate buffer at pH 4.5. Two milliliters of the xylanase solution is heated at 40° C. for 5 minutes and 0.25 mL of preheated Azo-Xylan is added to the enzyme solution. The mixture is incubated for 10 minutes at 40° C. The reaction is terminated and high molecular weight substrate is precipitated by adding 1.0 mL of ethanol (95% v/v) with vigorous stirring for 10 seconds on a vortex mixer. The reaction tubes are allowed to equilibrate to room temperature for 10 minutes and are then centrifuged at 2000 rpm for 6-10 minutes. The supernatant solution is transferred to a spectrophotometer cuvette and the absorbance of blank and reaction solutions measured at 590 nm. Activity is determined by measuring the level of dilution of the enzyme sample to achieve an absorbance of 0.5 Absorbance Units at 590 nm. Blanks are prepared by adding ethanol to the substrate before addition of enzyme and the absorbance of the blank is subtracted from that of the sample. The xylanase activity of the sample is then calculated by Equation (1):

$$A=1.07D \quad (1)$$

Where A=Enzyme activity, XU/mL

D=Dilution of enzyme sample to reach an absorbance of 0.5

Example 3

Determination of Amount of Xylan and Xylose Released by Xylanase Treatment

The quantity of xylose released by the treatment of chips with a xylanase enzyme in laboratory studies is determined as follows. First, a chip suspension is treated with enzyme in a polyethylene bag for 60 minutes at a solids consistency of 5.0%, a temperature of 63° C. and a pH of ~5.7 to 6.3. The pH of the pulp suspension is adjusted adding either 0.1 N caustic if he suspension is too acidic or 0.1 N sulfuric acid if the solution is too alkaline. Prior to adding the xylanase enzyme to the chips, the chip sample is pre-heated to the desired temperature in a thermostatic water bath so as to emulate operation in a mill, where enzyme is added to hot chips. A chip control sample is treated in exactly the same manner as the xylanase treated chips, except that water is used in place of a xylanase preparation, which is equivalent to a dosage of 0 XU/g pulp. After treatment, each chip suspension is filtered using a funnel having a fine filter paper that retains all of the solid particles and the filtrate is collected in a vial. The amount of xylan and xylose released after the treatment of the chips is determined by converting all of the xylan oligomers in solution into xylose monomers without destroying xylose monomers. This is achieved by adding 1 mL of 4% w/v sulfuric acid to a 1 mL aliquot of filtrate and then placing the acidified aliquot in an autoclave at 121° C. for 60 minutes to hydrolyze all xylan oligomers to xylose monomers. The amount of xylose in each hydrolyzed aliquot is determined by using a xylose standard on a Dionex High Performance Liquid Chromatograph using a Carbopac PA1 column and an electrochemical detector. The amount of xylose released is calculated as the difference between the measured quantities of xylose in a hydrolyzed aliquot for enzyme treated chips and the untreated control chips, and is expressed as mg xylose per gram of initial chips (oven dried basis).

Example 4

Treatment of Poplar Chips with Xylanases

Several samples of poplar chips were treated separately, with xylanases from the fungi and bacteria shown in Table 2. The enzyme Family is also noted based on Henrissat (1991, Biochem. J.; and Davies and Henrissat, 1995; which are herein incorporated by reference). The protein concentrations were determined using the method of Example 1 and the xylanase activities were determined using the method of Example 2.

TABLE 2

Enzymes tested and xylanase activity of each enzyme

| Source | Microbe | Family | Enzyme | MW (Kd) | Name | Protein (mg/mL) | Xylanase Activity (XU/mL) |
|---|---|---|---|---|---|---|---|
| Korsnas, Sweden | *Bacillus stearothermophilus* T6 | 10 | — | 43 | Xylanase T6 | 16.8 | — |
| IAF, Laval, Quebec | *Streptomyces lividans* | 10 | XynA | 30 | Strain 911-A8 | 5.78 | 800 |
| University of Georgia | *Thermotoga maritima** | 10 | XynA | 120 | — | 9.60 | 162 |
| Clariant | *Aureobasidium pullulans* | 11 | XynA | 21-22 | Cartazyme ® HS-10 | 15.3 | 29000 |
| Iogen | *Trichoderma reesei* | 11 | Xyn2 | 21 | Wildtype | 18.7 | 7000 |
| Iogen | *Trichoderma reesei* | 11 | Xyn2 | 21 | BIOBRITE ® EB | 39.2 | 3900 |
| Iogen | *Trichoderma reesei* | 11 | Xyn2 | 21 | BIOBRITE ® HTX | 59.5 | 480 |

*for *Thermotoga maritima*, the assay was conducted at pH 6 and 90° C.

The chips were treated with 0, 0.01, 0.04, 0.08 and 0.1 mg of protein per gram of poplar chips. Xylanase T6 (from *Bacillus stearothermophilus* T6), *Thermotoga maritima* xylanase, wild-type *T. reesei* XynII and BIOBRITE® EB were also dosed on the chips at 0.02 mg protein per gram of chips. For all chip and enzyme mixtures, the temperature was maintained at 63° C., the pH was maintained between pH 5.7 and 6.3, the chips were maintained at a 5% consistency and the reaction lasted 60 minutes. The amount of xylose released during the reaction period was measured using the method of Example 3. The results given in Table 3 for 0.1 mg of protein per gram of chips were determined by best-fit lines through semi-logarithmic plots of xylose release versus dosage.

TABLE 3

Xylose released by treating poplar chips with 0.1 mg xylanase per g chips

| Microbe | Family | Name | Xylose release (at 0.1 mg/g chips) |
|---|---|---|---|
| *Bacillus stearothermophilus* T6 | 10 | Xylanase T6 | 0.00 |
| *Streptomyces lividans* | 10 | Strain 911-A8 | 0.03 |
| *Thermotoga maritima* | 10 | | 0.00 |
| *Aureobasidium pullulans* | 11 | Cartazyme ® HS | 0.32 |
| *Trichoderma reesei* | 11 | Wild type | 0.21 |
| *Trichoderma reesei* | 11 | BIOBRITE ® EB | 0.37 |
| *Trichoderma reesei* | 11 | BIOBRITE ® HTX | 0.26 |

The xylose release at 0.1 mg protein/g chips was 2 to 3 times larger than the xylose release at 0.01 mg protein/g chips for the enzymes in Table 3. These results indicate that poplar chips may be treated with xylanase with a corresponding release of xylose. However, not all xylanases are equally efficient in releasing xylose, as treatments of poplar chips with Family 11 xylanases result in more xylose release than do those treated with Family 10 xylanases. Without wishing to be bound by theory, these indicate that Family 11 xylanases are more capable of penetrating the fibers and hydrolyzing xylan than the Family 10 xylanases.

Example 5

Measurement of Canadian Standard Freeness

The Canadian Standard Freeness (CSF) measures the drainability of a pulp, which is the ease with which water is removed from the pulp mass. CSF was measured using the Standard Test # ISO 5267-2 of the International Standards Organization and its unit is milliliters (mL). The CSF is the parameter that specifies the extent of mechanical pulping. Mechanical pulping is carried out by refining wood chips to a specified level of CSF.

Example 6

Refining of Poplar Chips after Xylanase Treatment in a Soaking Bin

BIOBRITE® EB xylanase (available from Iogen Corp.) was applied to hardwood chips, in this case the chips were from poplar, at a dosage of 20 XU/g chips, at 10% consistency and a temperature of 60° C. The treated chips were incubated for either 30 minutes or 60 minutes. Control chips were treated in exactly the same manner as the xylanase-treated chips, except that water was used in place of xylanase. At the end of the treatment, the chips were defibered at atmospheric pressure using a 12 inch laboratory refiner. The coarse pulps produced in the defibering were further refined at atmospheric pressure in a 12 inch laboratory refiner and the Canadian Standard Freeness (CSF) of the refined pulps was measured as a function of the specific energy of refining.

The relationship between the specific energy required to produce a specific CSF from the various enzymatic treatments of the chips is shown in FIG. 1. Treating poplar chips with xylanase prior to refining results in a significant decrease in refining energy to reach a given CSF. For example, treatment of poplar chips with BIOBRITE® EB for a 30 minute reaction period prior to refining produced a reduction in the energy requirement of at least 350 kWh/t relative to the untreated control. Treatment of the chips with BIOBRITE® EB for a period of 60 minutes, resulted in an even greater energy reduction of at least 500 kWh/t.

These results demonstrate that xylanase treatment of hardwood chips for an incubation period of 90 minutes or less results in a reduced energy requirement for subsequent refining of the chips.

Example 7

Refining of Spruce Chips after Xylanase Treatment in a Soaking Bin

Figure 2:
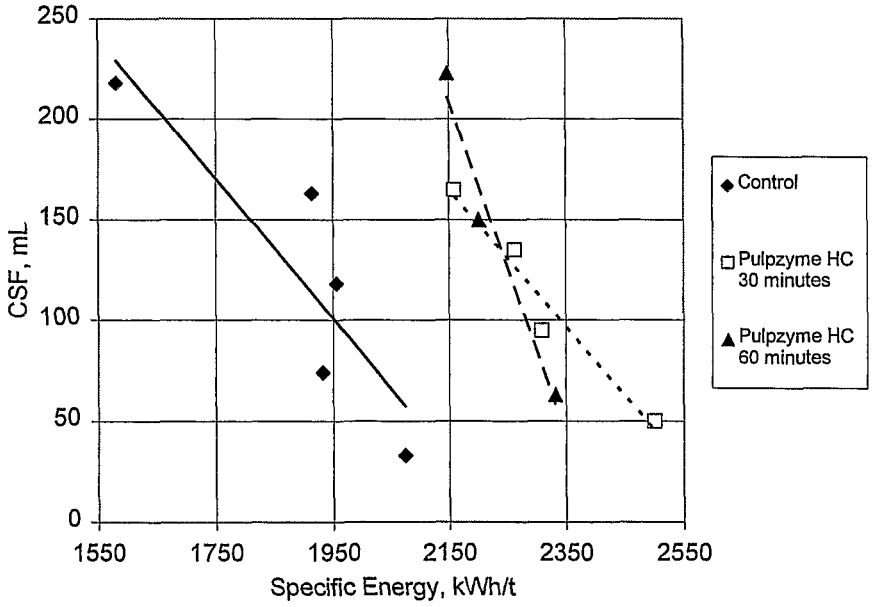
FIG. 2 shows the relationship between the freeness of the pulp (CSF; Canadian Standard Freeness) and the energy consumption (specific energy) for pulp produced from spruce chips in the absence of enzyme (Control) or chips that have been treated with PULPZYME® enzyme at a dosage of 20 XU/g chips for 30 minutes or 60 minutes as described in Example 7.

This example is given by way of comparison. Spruce chips were steamed at atmospheric pressure for 5 minutes. PULPZYME® HC xylanase NovoNordisk, 1000 XU/g product) was applied to the chips at a dosage of 20 XU/g chips, at 10% consistency and a temperature of 60° C. The solution was incubated for either 30 minutes or 60 minutes. Control chips were treated in exactly the same manner as the xylanase-treated chips, except that water was used in place of xylanase. After the enzyme treatment, the chips were steamed at 110° C. for 3 minutes. Following steaming, the chips were defibered under pressure using a 12 inch refiner and then refined at atmospheric pressure in a 12 inch laboratory refiner. The Canadian Standard Freeness (CSF) of the refined pulps was measured as a function of the specific energy of refining. The curves obtained are shown in FIG. 2. Treating the spruce chips with xylanase prior to refining results in a significant increase in refining energy to reach a given CSF. In the instance of PULPZYME® HC treatment of chips for 30 minutes, the energy increase was 350 kWh/t relative to the untreated control. In the instance of PULPZYME® HC treatment of chips for 60 minutes, the energy increase was 300 kWh/t relative to the untreated control. These results indicate that treatment of softwood chips with xylanase does not decrease refining energy relative to an untreated control.

Example 8

Refining of Poplar Chips after Xylanase Treatment in an Impregnation Device

BIOBRITE® HTX xylanase (available from Iogen Corp.) was applied to hardwood poplar chips at a dosage of 0.72 XU/g chips and a temperature of 60° C. The xylanase was applied to chips that had been pressed in a screw press having a 4:1 compression ratio and expelled from the screw press into the enzyme solution containing the xylanase. The chips absorbed the enzyme solution and were then conveyed to a reaction vessel where they reacted for 60 minutes. A control pulp was treated in exactly the same manner as the xylanase-treated chips, except that water was used in place of xylanase. At the end of the treatment, the chips were defibered in a pressurized 12 inch refiner. The coarse pulp was refined under atmospheric conditions in a 12 inch laboratory refiner and the Canadian Standard Freeness (CSF) of the refined pulp was measured as a function of the specific energy of refining.

BIOBRITE® HTX xylanase (available from Iogen Corp.) was applied to hardwood poplar chips at a dosage of 1.44 XU/g chips and a temperature of 60° C. The xylanase was applied to chips that had been pressed in a screw press having a 4:1 compression ratio and expelled from the screw press into the enzyme solution containing the xylanase. The chips absorbed the enzyme solution and were then conveyed to a reaction vessel where they reacted for 60 minutes. A control pulp was treated in exactly the same manner as the xylanase-treated chips, except that water was used in place of xylanase. At the end of the treatment, the chips were defibered in a pressurized 12 inch refiner. The coarse pulp was refined under atmospheric conditions in a 12 inch laboratory refiner and the Canadian Standard Freeness (CSF) of the refined pulp was measured as a function of the specific energy of refining.

Figure 3:
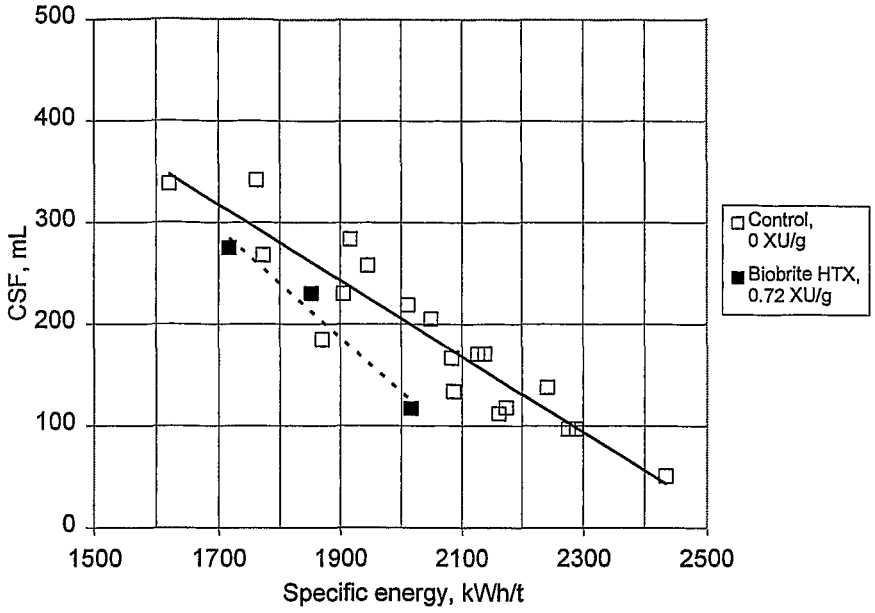
FIG. 3 shows a relationship between the freeness of the pulp (CSF; Canadian Standard Freeness) and the energy consumption (specific energy) for pulp produced from poplar chips in the absence of enzyme (Control) or chips that have been treated with BIOBRITE® HTX enzyme at a dosage of 0.72 XU/g chip for 60 minutes as described in Example 8.
Figure 4:
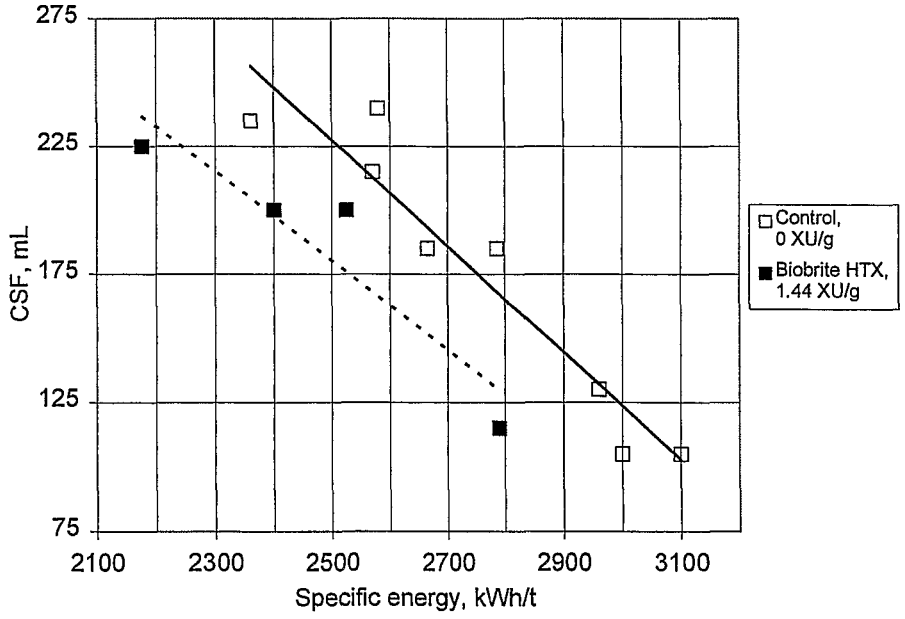
FIG. 4 shows a relationship between the freeness of the pulp (CSF; Canadian Standard Freeness) and the energy consumption (specific energy) for pulp produced from poplar chips in the absence of enzyme (Control) or chips that have been treated with BIOBRITE® HTX enzyme at a dosage of 1.44 XU/g chip for 60 minutes as described in Example 8.

The relationship between the specific energy required to produce a specific CSF from the enzymatic treatment of the poplar chips with 0.72 XU/g chips is shown in FIG. 3. Treating poplar chips with xylanase prior to refining results in a significant decrease in refining energy to reach a given CSF. For example, treatment of poplar chips with 0.72 XU BIOBRITE® HTX/g chips for a 60 minute reaction period prior to refining produced a reduction in the specific energy of at least 130 kWh/t relative to the untreated control at a CSF of 200 mL. Treatment of the chips with 1.44 XU BIOBRITE® HTX for a period of 60 minutes resulted in an even greater specific energy reduction of at least 210 kWh/t at a CSF of 200 mL as it is shown in FIG. 4.

Figure 5:
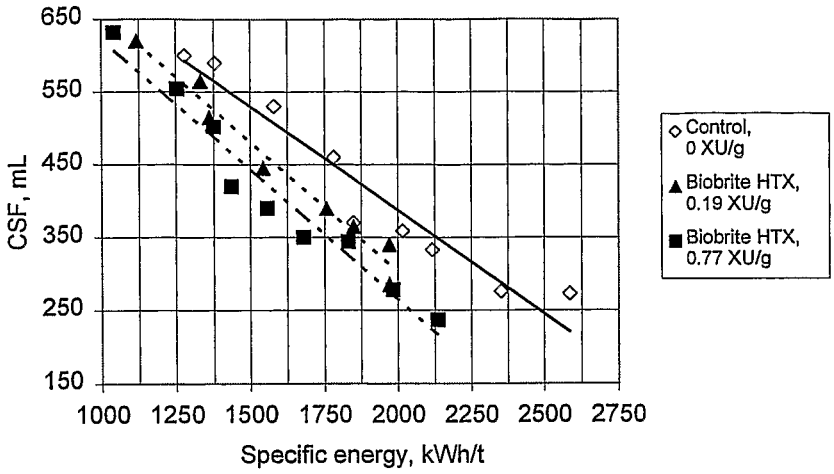
FIG. 5 shows a relationship between the freeness of the pulp (CSF; Canadian Standard Freeness) and the energy consumption (specific energy) for pulp produced from aspen chips in the absence of enzyme (Control) or chips that have been treated with BIOBRITE® HTX enzyme at dosages of 0.19 XU/g chip and 0.77 XU/g chip for 60 minutes as described in Example 8.

The effect of xylanase dosage is also shown in FIG. 5 where, in a separate experiment, hardwood aspen chips were treated with BIOBRITE® HTX. BIOBRITE® HTX xylanase (available from Iogen Corp.) was applied to hardwood aspen chips at a dosage of 0.19 and 0.77 XU/g chips at a temperature of 63° C. The xylanase was applied to chips that had been pressed in a screw press having a 2:1 compression ratio and expelled from the screw press into the enzyme solution containing the xylanase. The chips absorbed the enzyme solution and were then conveyed to a reaction vessel where they reacted for 60 minutes. A control pulp was treated in exactly the same manner as the xylanase-treated chips, except that water was used in place of xylanase. At the end of the treatment, the chips were defibered in a pressurized 12 inch refiner. The coarse pulp was refined under atmospheric conditions in a 12 inch laboratory refiner and the Canadian Standard Freeness (CSF) of the refined pulp was measured as a function of the specific energy of refining. In these experiments, treatment of poplar chips with 0.19 XU BIOBRITE® HTX/g chips for a 60 minute reaction period prior to refining produced a reduction in the specific energy of at least 260 kWh/t relative to the untreated control at a CSF of 350 mL. Increasing the xylanase treatment of poplar chips with 0.77 XU BIOBRITE® HTX/g chips for a 60 minute reaction period prior to refining produced a reduction in the specific energy at least 370 kWh/t relative to the untreated control at a CSF of 350 mL and demonstrated the beneficial impact of increasing the xylanase dosage upon the reduction of refining energy.

These results demonstrate that enzyme treatment of hardwood chips with 0.19 XU/g chips or more for a reaction period of 60 minutes results in a reduced energy requirement for subsequent refining of the chips and that increasing the dosage of xylanase applied to the chips results in an increase in the energy reduction.

All citations are hereby incorporated by reference.

The present invention has been described with regard to one or more embodiments. However, it will be apparent to persons skilled in the art that a number of variations and modifications can be made without departing from the scope of the invention as defined in the claims.

REFERENCES

Arase, A., Yomo, T., Urabe, I., Hata, Y., Katsube, Y. and Okada, H. (1993) FEBS Lett. 316:123-127.

Davies, G. and Henrissat, B., "Structures and mechanisms of glycosyl hydrolases", (1995) Structure 3, pp. 853-859.

Henrissat, B., "A classification of glycosyl hydrolases based on amino acid sequence similarities", (1991) Biochem. J. 289, pp. 309-316.

Megazyme International Ireland Limited, "Assay of endo-1, 4-β-Xylanase using azo-xylan (birchwood)", (2003), http://www.megazyme.com.

Smook, G. A. (1992) Handbook for Pulp & Paper Technologists, Angus Wilde Publications, Vancouver, Canada.

United States Department of Agriculture, (2004), plants.usda.gov.

The invention claimed is:

1. A method of producing hardwood pulp comprising:

(a) treating hardwood chips with a Family 11 xylanase enzyme from *Trichoderma* in the absence of adding an oxidizing enzyme for about 5 minutes to about 120 minutes, to produce a treated chip mixture; and thereafter (b) mechanically refining the treated chip mixture to produce the hardwood pulp, wherein the refining energy used in the mechanically refining step (b) is 10% to 50% less than the refining energy on a hardwood chip mixture not previously treated with a Family 11 xylanase enzyme from *Trichoderma.*

2. The method of claim 1, wherein the hardwood chips are at least one member selected from the group consisting of aspen, poplar, birch, maple, oak, eucalyptus and acacia.

3. The method of claim 1, wherein the *Trichoderma* is *Trichoderma reesei.*

4. The method of claim 3, wherein the Family 11 xylanase is Xylanase II.

5. The method of claim 1, wherein prior to the step of treating (step (a)), the hardwood chips are treated with one or more than one chemical agent selected from the group consisting of an acid, a base, an oxidant, a reductant, a chelant, a stabilizer, a surfactant, an enzyme and a combination thereof, in a soaking or wood compression-relaxation device, with the proviso that said oxidant and said enzyme are not oxidizing enzymes.

6. The method of claim 5, wherein:

the acid is selected from the group consisting of hydrochloric acid, sulfuric acid, sodium bicarbonate, formic acid, acetic acid, oxalic acid, hydroxyacetic acid and a combination thereof;

the base is selected from the group consisting of sodium hydroxide, magnesium hydroxide, potassium hydroxide, sodium carbonate, sodium bicarbonate, sodium silicate and a combination thereof;

the oxidant is selected from the group consisting of hydrogen peroxide, chlorine dioxide, oxygen, performic acid, peracetic acid, ozone and a combination thereof;

the reductant is selected from the group consisting of sodium sulfite, formamidinesulfinic acid, sodium hydrosulfite, sodium borohydride and a combination thereof;

the chelant is selected from the group consisting of ethylenediaminetetraacetic acid, diethylenetriaminepentaacetic acid, nitrilotriacetic acid, hydroxyacetic acid, oxalic acid and a combination thereof;

the stabilizer is selected from the group consisting of magnesium sulfate, magnesium chloride, magnesium nitrate, magnesium hydroxide, sodium silicate and a combination thereof;

the surfactant is selected from the group consisting of non-ionic, anionic, cationic and amphoteric surfactants and a combination thereof; and the enzyme is selected from the group consisting of a cellulase, a hemicellulase, a cell wall enzyme, an esterase and a combination thereof.

7. The method of claim 6, wherein the thermal treatment comprises treating the hardwood chips with steam or hot water.

8. The method of claim 1, wherein after the step of treating (step (a)) and before the step of refining (step (b)), the hardwood chips are treated with one or more than one chemical agent selected from the group consisting of an acid, a base, an oxidant, a reductant, a chelant, a stabilizer, a surfactant, an enzyme and a combination thereof, in a soaking or wood compression-relaxation device, and wherein said oxidant and said enzyme are not oxidizing enzymes.

9. The method of claim 8, wherein:

the acid is selected from the group consisting of hydrochloric acid, sulfuric acid, sodium bicarbonate, formic acid, acetic acid, oxalic acid, hydroxyacetic acid and a combination thereof;

the base is selected from the group consisting of sodium hydroxide, magnesium hydroxide, potassium hydroxide, sodium carbonate, sodium bicarbonate, sodium silicate and a combination thereof;

the oxidant is selected from the group consisting of hydrogen peroxide, chlorine dioxide, oxygen, performic acid, peracetic acid, ozone and a combination thereof;

the reductant is selected from the group consisting of sodium sulfite, formamidinesulfinic acid, sodium hydrosulfite, sodium borohydride and a combination thereof;

the chelant is selected from the group consisting of ethylenediaminetetraacetic acid, diethylenetriaminepentaacetic acid, nitrilotriacetic acid, hydroxyacetic acid, oxalic acid and a combination thereof;

the stabilizer is selected from the group consisting of magnesium sulfate, magnesium chloride, magnesium nitrate, magnesium hydroxide, sodium silicate and a combination thereof;

the surfactant is selected from the group consisting of non-ionic, anionic, cationic and amphoteric surfactants and a combination thereof; and the enzyme is selected from the group consisting of a cellulase, a hemicellulase, a cell wall enzyme, an esterase and a combination thereof.

10. The method of claim 9 wherein the thermal treatment comprises treating the hardwood chips with steam or hot water.

11. The method of claim 1, wherein prior to the step of treating (step (a)) the hardwood chips are thermally treated.

12. The method of claim 1, wherein after the step of treating (step (a)) and before the step of refining (step (b)), the hardwood chips are thermally treated.

13. The method of claim 1 wherein, in the step of treating (step a.), the Family 11 xylanase enzyme is added with a cellulase, a hemicellulase, a cell wall enzyme, an esterase or a combination thereof.

14. The method of claim 13, wherein:

the hemicellulase is selected from the group consisting of mannanase, arabinase, galactase, pectinase and a combination thereof;

the cell wall enzyme is selected from the group consisting of expansin, swollenin, Xyloglucan endotransglycosylase and a combination thereof; and the esterase comprises ferulic esterases.

15. The method of claim 1, wherein the step of treating (step (a)) is performed at a temperature from about 35° C. to about 85° C.

16. The method of claim 1, wherein the step of treating (step (a)) is performed at from about pH 3 to about 11.

17. The method of claim 1, wherein, in the step of treating (step (a)), the Family 11 xylanase is present at an amount from about 0.01 to about 600 xylanase units per gram of hardwood chips.

18. The method of claim 1, wherein the step of treating (step (a)) is performed in the absence of adding a lipase enzyme.

19. The method of claim 1, wherein in the step of treating (step (a)), the Family 11 xylanase is present at an amount from about 0.1 to about 600 grams of xylanase protein per tonne of hardwood chips.

* * * * *